US010361540B2

(12) United States Patent
MIXELL et al.

(10) Patent No.: US 10,361,540 B2
(45) Date of Patent: Jul. 23, 2019

(54) AIR-FREE CAP END DESIGN FOR CORONA IGNITION SYSTEM

(71) Applicant: FEDERAL-MOGUL LLC, Southfield, MI (US)

(72) Inventors: KRISTAPHER MIXELL, Plymouth, MI (US); Paul Phillips, Brighton, MI (US)

(73) Assignee: Tenneco Inc, Lake Forest, IL (US)

( * ) Notice: Subject to any disclaimer, the term of this patent is extended or adjusted under 35 U.S.C. 154(b) by 0 days.

(21) Appl. No.: 15/948,238

(22) Filed: Apr. 9, 2018

(65) Prior Publication Data

US 2018/0261984 A1 Sep. 13, 2018

Related U.S. Application Data

(62) Division of application No. 15/271,874, filed on Sep. 21, 2016, now Pat. No. 9,941,671.

(60) Provisional application No. 62/232,085, filed on Sep. 24, 2015.

(51) Int. Cl.

| | |
|---|---|
| ***H01T 19/00*** | (2006.01) |
| ***F02P 23/04*** | (2006.01) |
| ***H01T 13/50*** | (2006.01) |
| ***H01T 21/02*** | (2006.01) |
| ***H01T 13/04*** | (2006.01) |

(52) U.S. Cl.

CPC ..... *H01T 19/00* (2013.01); *F02P 23/04* (2013.01); *H01T 13/04* (2013.01); *H01T 13/50* (2013.01); *H01T 21/02* (2013.01)

(58) Field of Classification Search

CPC ..... H01T 19/00; H01T 13/50; H01T 21/02; F02P 23/04

See application file for complete search history.

(56) References Cited

U.S. PATENT DOCUMENTS

| | | | |
|---|---|---|---|
| 2,280,962 A | 4/1942 | McDougal | |
| 2010/0175653 A1 | 7/2010 | Lykowski et al. | |
| 2014/0268480 A1* | 9/2014 | Urciuoli | H01T 19/04 361/263 |

OTHER PUBLICATIONS

International Search Report, dated Jan. 20, 2017 (PCT/US2016/053294).

* cited by examiner

*Primary Examiner* — Kevin Quarterman
(74) *Attorney, Agent, or Firm* — Robert L. Stearns; Dickinson Wright, PLLC

(57) ABSTRACT

A corona igniter assembly including an ignition coil assembly, a firing end assembly, and a dielectric compliant member is provided. The dielectric compliant member is compressed between a high voltage insulator of the ignition coil assembly and a ceramic insulator of the firing end assembly. During assembly of the corona igniter assembly, the dielectric compliant member pushes air outwards and forms a hermetic seal between the high voltage insulator and the ceramic insulation. The dielectric compliant member can have a rounded upper surface, which may improve the hermetic seal. Alternatively, or in addition to the rounded surface on the dielectric compliant member, the lower surface of the high voltage insulator can be rounded to push air outwards during assembly and provide a hermetic seal.

14 Claims, 5 Drawing Sheets

AIR-FREE CAP END DESIGN FOR CORONA IGNITION SYSTEM

CROSS-REFERENCE TO RELATED APPLICATIONS

This U.S. Divisional Application claims priority to U.S. Utility application Ser. No. 15/271,874, filed Sep. 21, 2016 which claims priority to U.S. Provisional Patent Application No. 62/232,085, filed Sep. 24, 2015, both of which are incorporated herein by reference in their entirety.

BACKGROUND

1. Field of the Invention

This invention relates generally to corona ignition assemblies, and methods of manufacturing the corona ignition assemblies.

2. Related Art

Corona discharge ignition systems include a corona igniter assembly typically with a firing end assembly and an ignition coil assembly attached to one another and inserted into a combustion chamber of an engine. The firing end assembly includes a central electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. The electric field is also preferably controlled so that the fuel-air mixture does not lose all dielectric properties, which would create a thermal plasma and an electric arc between the electrode and grounded cylinder walls, piston, or other portion of the igniter. Ideally, the field is also controlled so that the corona discharge only forms at the firing end and not along other portions of the corona igniter assembly. However, such control is oftentimes difficult to achieve.

SUMMARY

One aspect of the invention provides a corona igniter assembly comprising an ignition coil assembly, a firing end assembly, and a dielectric compliant member compressed between the ignition coil assembly and the firing end assembly to provide a hermetic seal therebetween. The ignition coil assembly includes a high voltage insulator formed of an insulating material, and the firing end assembly includes a ceramic insulator formed of a ceramic material. The dielectric compliant member extends from an upper surface engaging the high voltage insulator to a bottom surface engaging the ceramic insulator. The upper surface of the dielectric compliant member is rounded, which may improve the hermetic seal between the high voltage insulator and the ceramic insulator.

Another aspect of the invention provides a corona igniter assembly comprising an ignition coil assembly, a firing end assembly, and a dielectric compliant member compressed between the ignition coil assembly and the firing end assembly. The ignition coil assembly includes a high voltage insulator formed of an insulating material, and the firing end assembly includes a ceramic insulator formed of a ceramic material. The dielectric compliant member is compressed between a lower surface of the high voltage insulator and an upper surface the ceramic insulator to provide a hermetic seal therebetween. In this embodiment, the lower surface of the high voltage insulator is rounded, which may improve the hermetic seal between the high voltage insulator and the ceramic insulator.

Yet another aspect of the invention provides a method of manufacturing a corona igniter assembly. The method includes compressing a dielectric compliant member between a high voltage insulator formed of an insulating material and a ceramic insulator formed of a ceramic material. The dielectric compliant member extends from an upper surface engaging the high voltage insulator to a bottom surface engaging the ceramic insulator, and the upper surface of the dielectric compliant member is rounded. The step of compressing the dielectric compliant member includes forming a hermetic seal between the high voltage insulator and the ceramic insulator.

Another aspect of the invention provides a method of manufacturing a corona igniter assembly including compressing a dielectric compliant member between a lower surface of a high voltage insulator formed of an insulating material and an upper surface of a ceramic insulator formed of a ceramic material. In this embodiment, the lower surface of the high voltage insulator is rounded. The step of compressing the dielectric compliant member includes forming a hermetic seal between the high voltage insulator and the ceramic insulator.

When the dielectric compliant member is compressed between the ignition coil assembly and the firing end assembly, the dielectric compliant member pushes trapped air out of the corona igniter assembly. The compressed dielectric compliant member can also fill air gaps located between the ignition coil assembly and firing end assembly. Thus, the dielectric compliant member can prevent unwanted corona discharge from forming in those air gaps, which could occur if a high voltage and frequency electrical field ionizes the trapped air. Preventing the unwanted corona discharge allows the energy to be directed to the corona discharge formed at a firing end of the firing end assembly, which in turn improves the performance of the corona igniter assembly. A rounded surface on the dielectric compliant member or the high voltage insulator at the interface between the dielectric compliant member and ignition coil assembly may contribute to an improved seal and thus improved performance of the corona igniter assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF EXAMPLE EMBODIMENTS

Figure 1:
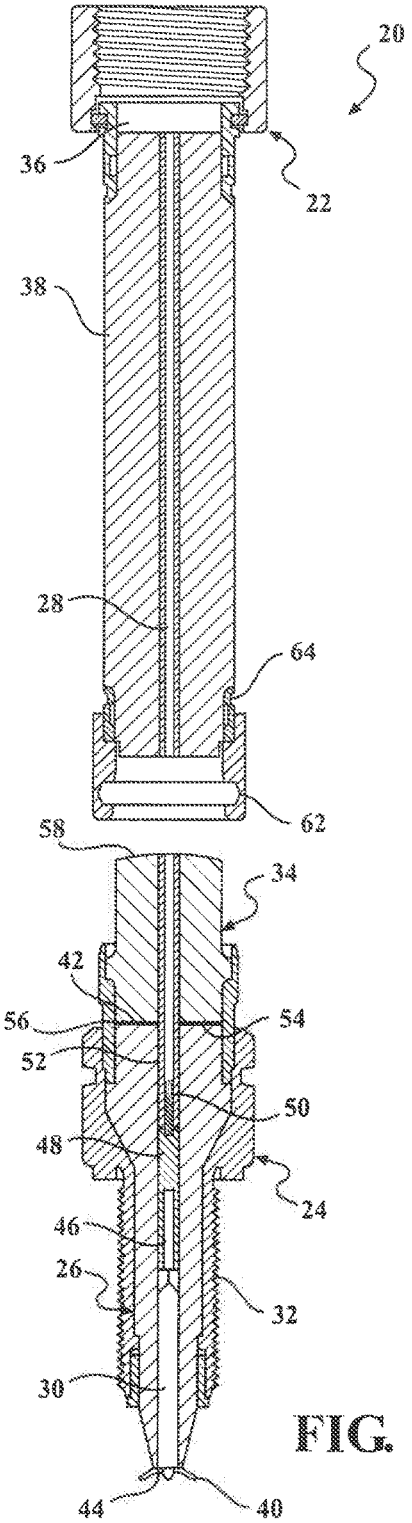
FIG. 1 is a cross-sectional view of an ignition coil extension, firing end assembly, and dielectric compliant member of a corona igniter assembly in a free state, according to example embodiment of the invention.
Figure 1A:
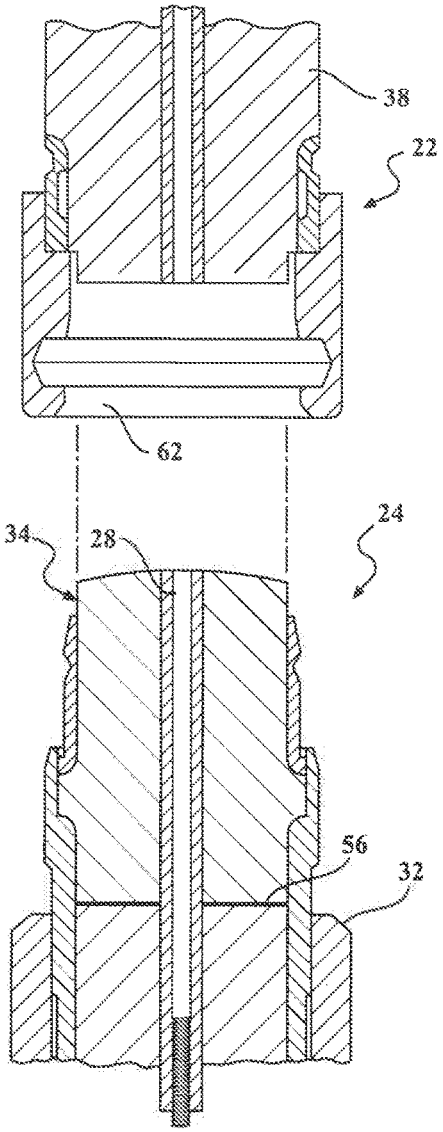
FIG. 1A is an enlarged view of an interface of the dielectric compliant member and the ignition coil extension of FIG. 1.
Figure 2:
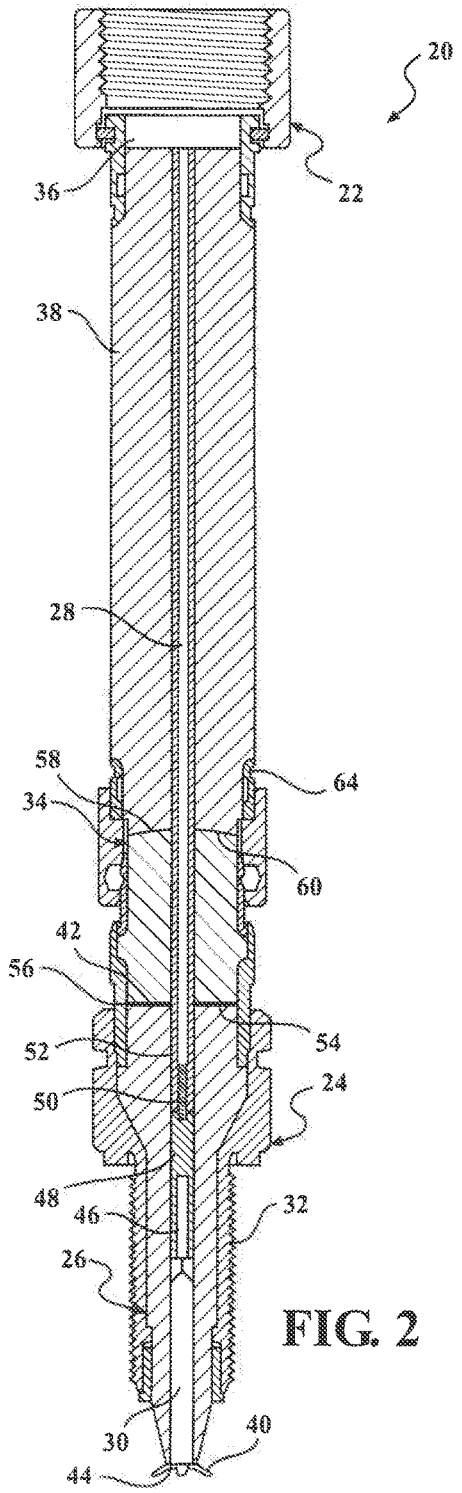
FIG. 2 is a cross-sectional view of the corona igniter assembly of FIG. 1 as-assembled.
Figure 2A:
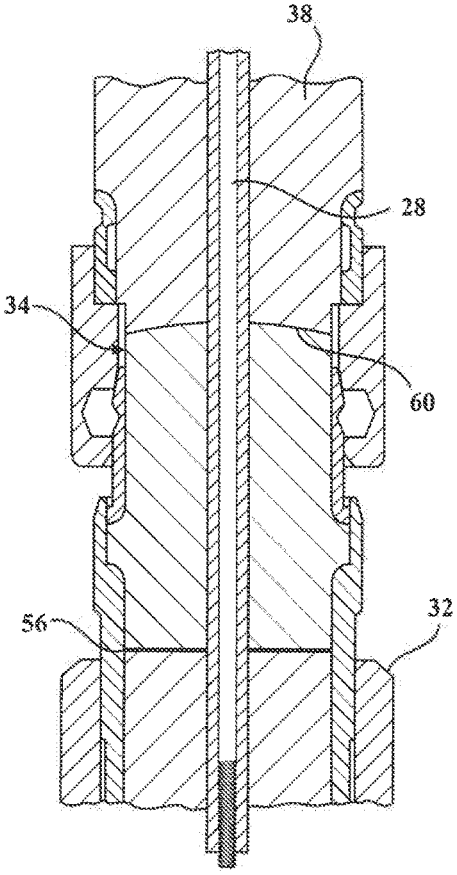
FIG. 2A is an enlarged view of the interface of the dielectric compliant member and the ignition coil extension of FIG. 2.

One aspect of the invention provides a corona igniter assembly 20 for an internal combustion engine, as shown in FIGS. 1 and 2. The corona igniter assembly 20 includes an ignition coil assembly, including an ignition coil extension 22, producing a high radio frequency and high voltage electrical field and a firing end assembly 24 distributing the electrical field in the combustion chamber for fuel ignition. The firing end assembly 24 includes a ceramic insulator 26 disposed between a central conductor, including a high voltage electrode 28 and central electrode 30, and a metal shell 32. While moving from the ignition coil extension 22 to the output of the firing end assembly 24, the electrical field loads and unloads the capacitance between the central conductor and the metal shell 32, moving radially across the section of the components. This behavior implies the interaction of all the materials in the assembly to the electrical performances of the system.

The metal shell 32 and the high voltage insulation problems at the electrical connection interfaces make the adoption of diverse materials within one component very complex. In particular, utilizing insulating materials with different electrical properties generates a lack of conformity of the electrical field and, if cavities are created at the interfaces, static charge concentrates and unwanted corona leakages can be experienced. The electrical field concentrates in any air gap within the insulating layer, thus increasing the probability of reaching the corona inception level. Corona leakages lead to material degradation and can eventual cause the parts to fail due to electrical discharge. Air gaps can be generated also by the materials creep when operating in the ambient temperature range (−40° C. to 150° C.). In addition, the very dissimilar coefficients of thermal expansion of the materials can lead to air gaps when operating in the ambient temperature range. Unwanted corona discharge can form in those air gaps, which reduces the strength of the corona discharge at the firing end. On the other hand, the adoption of different insulating materials within the corona igniter assembly 20 is a key success factor that provides improved performance, including efficiency and robustness of the parts in the field.

In order to fill unwanted air gaps between the ignition coil extension 22 and firing end assembly 24, while using the different insulating materials, a dielectric compliant member 34, also referred to as a cap end, is compressed between the ignition coil extension 22 and the firing end assembly 24. In other words, the dielectric compliant member 34 allows the interface that is assembled in the field to be between dissimilar materials. Preferably, the dielectric compliant member 34 is permanently attached to the ceramic insulator 26, and the shape of the mating surfaces is engineered so that a void/air free joint can be obtained reliably at each installation.

The components of the corona igniter assembly 20 will now be described in more detail. The ignition coil extension 22 includes a plurality of windings receiving energy from a power source (not shown) and generating the high radio frequency and high voltage electric field. The ignition coil extension 22 extends along a center axis and includes a coil output member 36 for transferring energy to the high voltage electrode 28 and ultimately to the firing end assembly 24. In the example embodiment, the high voltage electrode 28 is surrounded by a high voltage insulator 38. The high voltage insulator 38 is formed of an insulating material which is different from the ceramic insulator 26 of the firing end assembly 24 and different from the dielectric compliant member 34, for example a rubber or plastic material. Typically, the high voltage electrode 28 extends longitudinally through a bore of the high voltage insulator 38, the dielectric compliant member 34, and an upper portion of a bore of the ceramic insulator 36.

Typically, the high voltage insulator 38 has a coefficient of thermal expansion (CLTE) which is greater than the coefficient of thermal expansion (CLTE) of the ceramic insulator 26. This insulating material has electrical properties which keeps capacitance low and provides good efficiency. Table 1 lists preferred dielectric strength, dielectric constant, and dissipation factor ranges for the high voltage insulator 38; and Table 2 lists preferred thermal conductivity and coefficient of thermal expansion (CLTE) ranges for the high voltage insulator 38. In one example embodiment, the high voltage insulator 38 is formed of a fluoropolymer, such as polytetrafluoroethylene (PTFE). The high voltage insulator 38 could alternatively be formed of other materials having electrical properties within the ranges of Table 1 and thermal properties within the ranges of Table 2.

TABLE 1

| Parameter | Value | U.M. | Testing conditions |
|---|---|---|---|
| Dielectric strength | >30 | kV/mm | −40° C., +150° C. |
| Dielectric constant | ≤2.5 | | 1 MHz; −40° C., +150° C. |
| Dissipation factor | <0.001 | | 1 MHz −40° C., +150° C. |

TABLE 2

| | | | |
|---|---|---|---|
| Thermal conductivity | >0.8 | W/mK | 25° C. |
| CLTE | <35 | ppm/K | −40° C., +150° C. |

The firing end assembly 24 includes the central electrode 30 for receiving the energy from the high voltage electrode 28 and distributing the radio frequency electric field in the combustion chamber. In the exemplary embodiment shown in FIGS. 1 and 2, the central electrode 30 includes a crown 40 at the firing end. The crown 40 includes a plurality of branches extending radially outwardly relative to the center axis for distributing the radio frequency electric field and forming a robust corona discharge.

The insulator 26 of the firing end assembly 24 is typically formed of a ceramic material and extends along the center axis from an insulator end wall 42 to an insulator firing end 44 adjacent the crown 40. The ceramic insulator 26 withstands the operating conditions in the combustion chamber but has very high capacitance that drives power requirements for the system and, therefore, should be kept as small as possible. The ceramic insulator 26 includes an insulator bore receiving the central electrode 30, and the crown 40 is disposed outwardly of the insulator firing end 44. The firing end assembly 24 also includes an electrical terminal 46 received in the bore of the ceramic insulator 26 and extending from the central electrode 30 toward the high voltage electrode 28. The metal shell 32 of the firing end assembly 24 surrounds the central electrode 30 and the ceramic insulator 26.

Typically, a brass pack 48 is disposed in the bore of the ceramic insulator 26 to electrically connect the high voltage electrode 28 and the electrical terminal 46. In addition, the high voltage electrode 28 is preferably able to float along the bore of the high voltage insulator 38 and compensate for assembly variability when the ignition coil extension 22 is installed. Since the HV connection point inside the plug is fixed, a moving (axially compliant) connection solution is needed so that the high voltage electrode 28 can float. In the example embodiment, a spring 50, or another axially complaint member, is disposed between the brass pack 48 and the high voltage electrode 28. Alternatively, although not shown, the spring 50 or another floating-connection solution could be located between the high voltage electrode 28 and the coil output member 36.

The firing end assembly 24 further includes a semi-conductive sleeve 52 surrounding the spring 50 and the high voltage electrode 28. The semi-conductive sleeve 52 is disposed in the bore of the ceramic insulator 26. The semi-conductive sleeve 52 extends continuously, uninterrupted, from the coil output member 36 along the interfaces between the high voltage insulator 38, dielectric compliant member 34, and ceramic insulator 26, to the brass pack 48.

The semi-conductive sleeve 52 is typically formed from a semi-conductive and compliant material, which is different from the other semi-conductive and complaint materials used in the corona igniter assembly 20. The complaint nature of the semi-conductive sleeve 52 allows the semi-conductive sleeve 52 to fill air gaps that could be located along the high voltage electrode 28, the insulators 26, 38, and the dielectric compliant member 34. In the exemplary embodiment, the semi-conductive sleeve 52 is formed of a semi-conductive rubber material, for example a silicone rubber. The semi-conductive sleeve 52 includes some conductive material, for example a conductive filler, to achieve the partially conductive properties. In one embodiment, the conductive filler is graphite or a carbon-based material, but other conductive or partially conductive materials could be used. The material used to form the semi-conductive sleeve 52 can also be referred to as partially conductive, weakly-conductive, or partially resistive. The high voltage and high frequency (HV-HF) nature of the semi-conductive sleeve 52 behaves like a conductor. The resistivity or DC conductivity of the semi-conductive sleeve 52 can vary from 0.5 Ohm/mm to 100 Ohm/mm, without sensibly changing the behavior of the corona igniter assembly 20. In the exemplary embodiment, the semi-conductive sleeve 52 has a DC conductivity of 1 Ohm/mm.

As shown in FIGS. 1 and 2, the dielectric compliant member 34 is compressed between the high voltage insulator 38 of the ignition coil extension 22 and the ceramic insulator 26 of the firing end assembly 24. The dielectric compliant member 34 provides an axial compliance which compensates for the differences in coefficients of thermal expansion between the ceramic insulator 26 and the high voltage insulator 38, or between the ceramic insulator 26 and another plastic or rubber material of the ignition coil extension 22. The compression force applied to the dielectric compliant member 34 is set by design to be within the elastic range of the chosen material. Typically, the dielectric compliant member 34 is formed of rubber or a silicon compound, such as a silicon paste or injection molded silicon.

Figure 3:
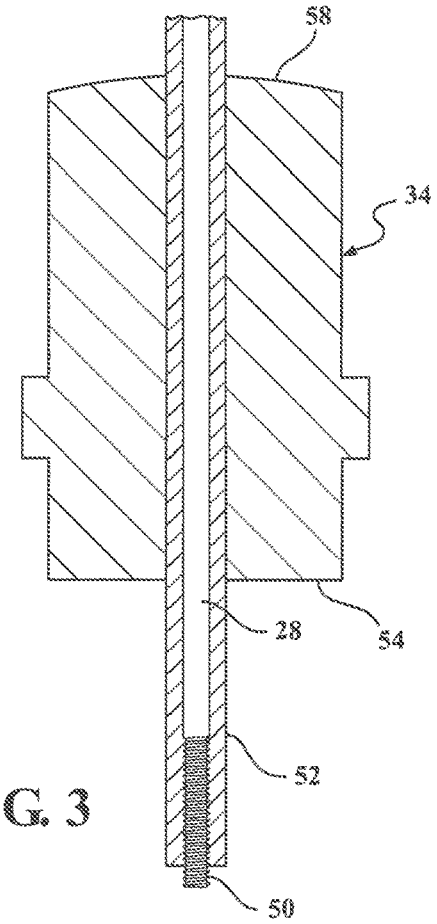
FIG. 3 is an enlarged view of the dielectric compliant member of FIG. 1.
Figure 4:
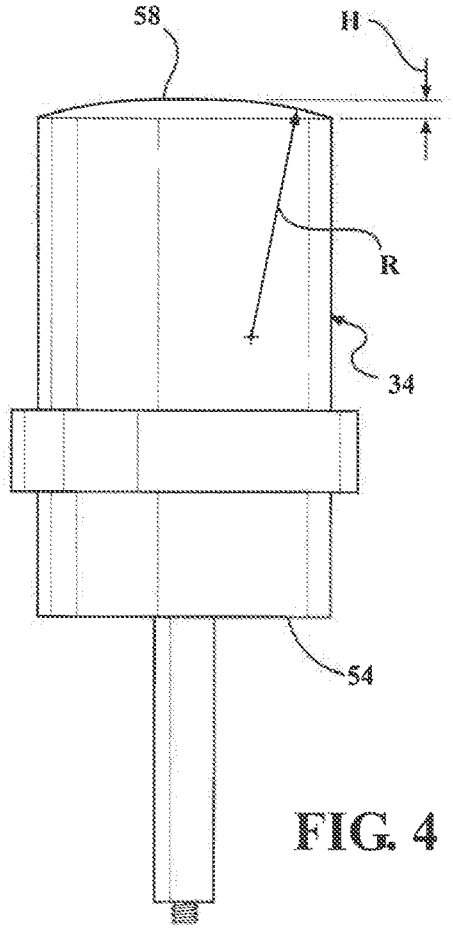
FIG. 4 is another enlarged view of the dielectric compliant member of FIG. 1 identifying the radius and height of a rounded upper surface on the dielectric compliant member.

As shown in FIGS. 3 and 4, the dielectric compliant member 34 includes a bottom surface 54 which is flat and permanently attached to the insulator end wall 42 of the ceramic insulator 26. This lower interface, ceramic to rubber, can be compressed with a mechanical die-press process. The seal between the dielectric compliant member 34 and the ceramic insulator 26 can be ensured by the compression and by chemical adhesion. For example, glue 56 can be applied along the interface of the dielectric compliant member 34 and the ceramic insulator 26. Thus, when the compression is voided by the thermal expansion and creep of the materials, the glue 56 keeps the interface void-free and prevents from the formation of corona tracking. The glue 56 can also be applied along other interfaces of the corona igniter assembly 20. The glue 56 is typically applied in liquid form so that it flows into all of the crevices and air gaps along the interface. In the example embodiment, the glue 56 is applied to a thickness in the range of 0.05 millimeters to 4 millimeters, but other thicknesses are possible. The glue 56 is cured during the manufacturing process and thus is solid or semi-solid (non-liquid) to provide some compliance along the interfaces in the finished corona igniter assembly 20.

The glue 56 is formed of an electrically insulating material and thus is able to withstand some corona formation. The glue 56 is also capable of surviving the ionized ambient generated by the high frequency, high voltage field during use of the corona igniter assembly 20 in an internal combustion engine. In one example embodiment, the glue 56 is formed of silicon and has the properties listed in Table 4. However, other materials having properties similar to those of Table 4 could be used to form the glue 56.

TABLE 4

| CTM* | ASTM** | Property | Unit | Result |
|---|---|---|---|---|
| | | As supplied | | |
| | | Appearance | | Non-slump paste |
| | | Colors | | Black, white, gray |
| 0364 | D2452 | Extrusion rate[1] | g/minute | 185 |
| 0098 | | Skin-over time | minutes | 15 |
| 0095 | MIL-S-8802E | Tack-free time[2] | minutes | 28 |
| Mechanical properties, cured 7 days in air at 23° C. (73° F.) and 50% relative humidity | | | | |
| 0099 | D2240 | Durometer hardness, Shore A | | 32 |
| 0137A | D412 | Tensile strength | MPa | 2.5 |

TABLE 4-continued

| CTM* | ASTM** | Property | Unit | Result |
|---|---|---|---|---|
| 0137A | D412 | Elongation at break | % | 680 |
| 0137A | D412 | Tear strength · die B | kN/m | 15 |
| 0022 | D0792 | Specific gravity at 22° C. (72° F.) | | 1.4 |
| Adhesion cured 7 days at 23° C. (73° F.) and 50% relative humidity | | | | |

The dielectric compliant member 34 also includes a rounded upper surface 58 having a predetermined height and radius, which is identified in FIG. 4. The shape of the upper surface 58 of the compliant dielectric member 34, which mates to a lower surface 60 of the high voltage insulator 38 of the ignition coil extension 22, is designed so that the installation (operated in the field by the customer) results in an air/void-free joint. The upper surface 58 of the dielectric compliant member 34 can be of any radius from flat to spherical, for example from slightly curved to spherical, and its key function is pushing air outwards during assembly while keeping the part geometry and manufacturability simple, so that an air/void-free joint can be obtained. Alternatively, the rounded geometry of the upper surface 58 of the dielectric compliant member 34 could be replicated on the lower surface 60 of the high voltage insulator 38, in addition to or instead of on the upper surface 58 of the dielectric compliant member 34. The rounded surface(s) could also be present on an interface between any other two mating surfaces in the corona igniter assembly 20 to provide an improved seal and prevent the unwanted corona discharge.

During the process of assembling the example corona igniter assembly 20 including the rounded upper surface 58, the center of the lower surface 60 of the high voltage insulator 38 and the center of the upper surface 58 of the dielectric compliant member 34 mate first, and as the parts are pressed together, the contact point moves radially outwards from the center, pushing the air out. In addition, as shown in FIG. 1, a connector 62 can be disposed around the interface between the high voltage insulator 38 and the dielectric compliant member 34. The corona igniter assembly 20 can also include additional metal shielding 64 to couple the metal shell 32 of the firing end assembly 24 to the ignition coil extension 22.

Figure 5:
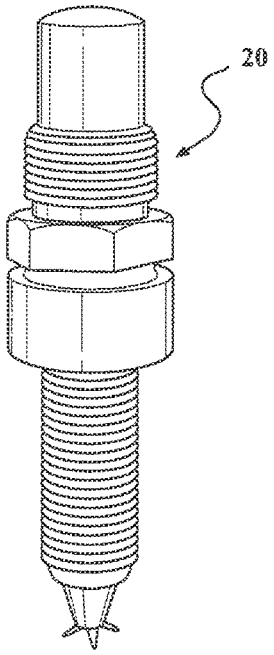
FIG. 5 is a perspective view of the assembled corona igniter assembly according to an example embodiment.
Figure 6:
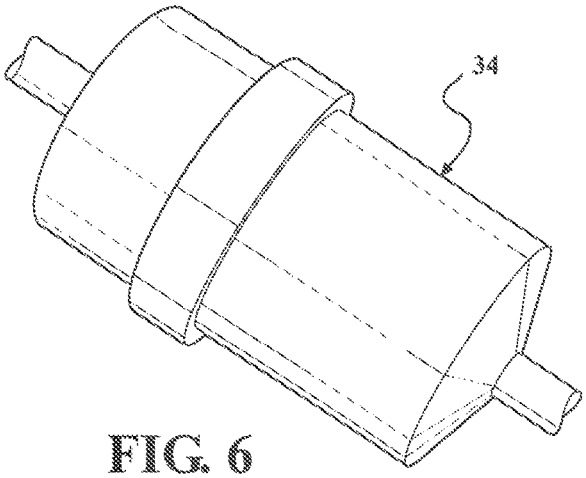
FIG. 6 is a perspective view of the dielectric compliant member of the corona igniter assembly of FIG. 5.
Figure 7:
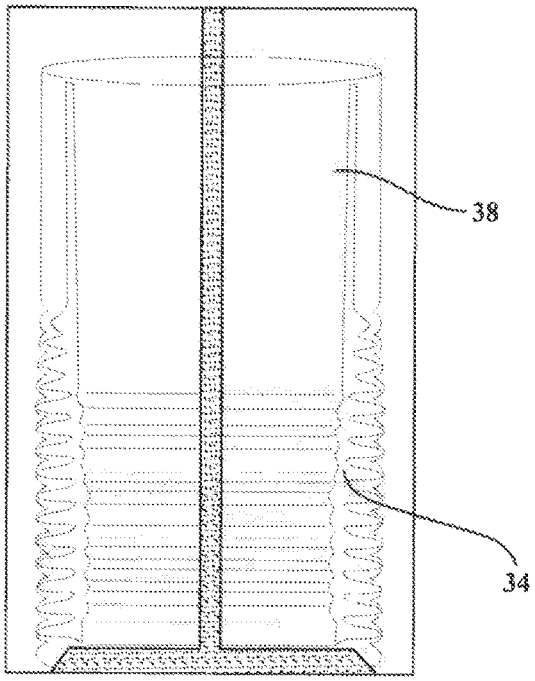
FIG. 7 is an X-ray image of the joint between the dielectric compliant member and the ignition coil extension according to an example embodiment.

FIG. 5 is a perspective view of the corona igniter assembly 20 after pressing the ignition coil extension 22 onto the dielectric compliant member 34. FIG. 6 is a perspective view of the dielectric compliant member 34 of the corona igniter assembly 20 of FIG. 5, and FIG. 7 is an X-ray image of the joint between the dielectric compliant member 34 and the high voltage insulator 38 of the ignition coil extension 22.

Figure 8:
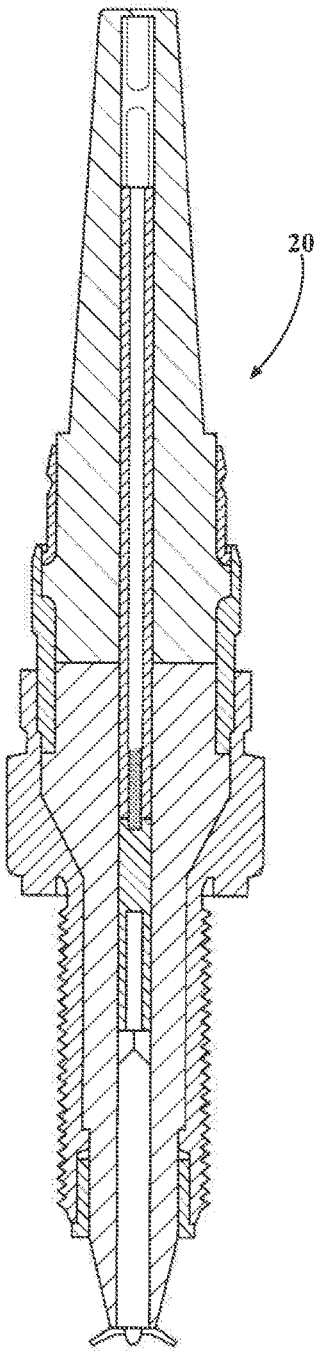
FIG. 8 is a cross-sectional view of a comparative corona igniter including a dielectric compliant member having a conical shape and without a rounded surface.
Figure 9:
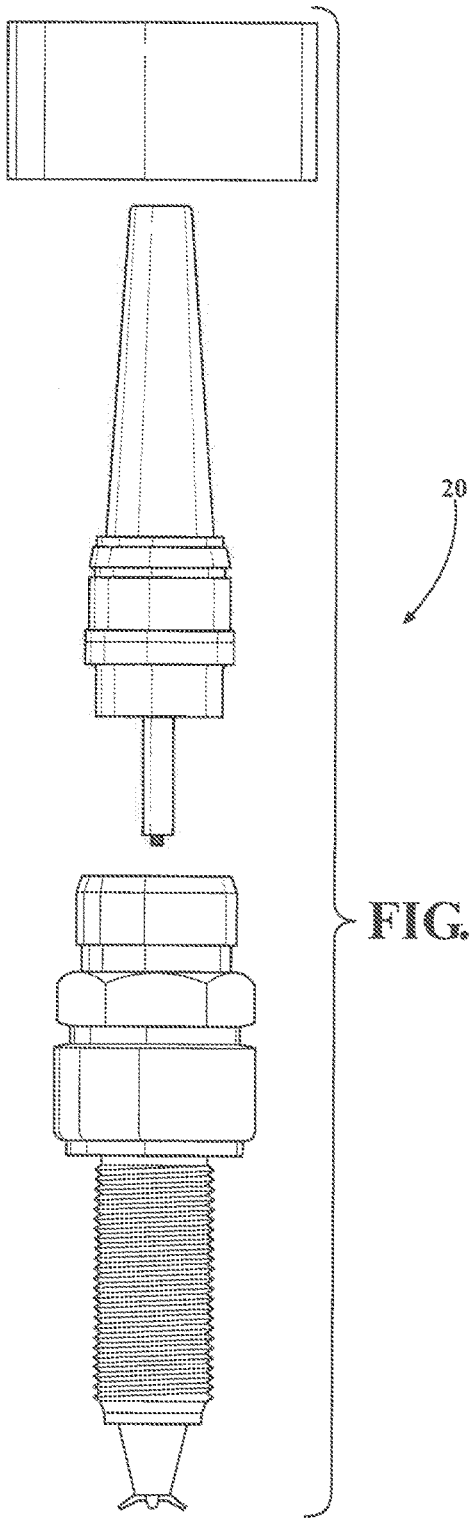
FIG. 9 illustrates the process of mechanically attaching the dielectric compliant member to a metal shell of the firing end assembly of FIG. 8.

The dielectric compliant member 34 of the present invention, which includes the rounded upper surface 58, is easier to replicate and may provide a better seal between the ignition coil extension 22 and firing end assembly 24, compared to a dielectric compliant member having a tapered or conical shape, as shown in FIGS. 8 and 9.

Obviously, many modifications and variations of the present invention are possible in light of the above teachings and may be practiced otherwise than as specifically described while within the scope of the invention.

The invention claimed is:

1. A method of manufacturing a corona igniter assembly, comprising:

disposing a high voltage electrode in a bore of a high voltage insulator, a bore of a dielectric compliant member, and a portion of a bore of a ceramic insulator; the high voltage insulator being formed of an insulating material and the ceramic insulator being formed of a ceramic material;

disposing a semi-conductive sleeve in the bore of the ceramic insulator and around the high voltage electrode, the semi-conductive sleeve extending continuously and uninterrupted along interfaces between the high voltage insulator, the dielectric compliant member, and the ceramic insulator; and compressing the dielectric compliant member between the high voltage insulator and the ceramic insulator, wherein the dielectric compliant member extends from an upper surface engaging the high voltage insulator to a bottom surface engaging the ceramic insulator, and the upper surface of the dielectric compliant member is rounded;

the step of compressing the dielectric compliant member including forming a hermetic seal between the high voltage insulator and the ceramic insulator.

2. The method of claim 1, wherein the dielectric compliant member pushes air outwards from between the high voltage insulator and the ceramic insulator during the step of compressing the dielectric member.

3. The method of claim 1, wherein the dielectric compliant member is formed of silicon paste or injected molded silicon.

4. The method of claim 1, wherein the ceramic material of the ceramic insulator is different from the insulating material of the high voltage insulator.

5. The method of claim 4, wherein the high voltage insulator is formed of rubber or plastic material.

6. The method of claim 1, wherein the semi-conductive sleeve is formed from a semi-conductive and compliant material different from the dielectric compliant member.

7. The method of claim 1 including applying glue to voids along an interface between the dielectric compliant member and the ceramic insulator.

8. A method of manufacturing a corona igniter assembly, comprising:

disposing a high voltage electrode in a bore of a high voltage insulator, a bore of a dielectric compliant member, and a portion of a bore of a ceramic insulator; the high voltage insulator being formed of an insulating material and the ceramic insulator being formed of a ceramic material;

disposing a semi-conductive sleeve in the bore of the ceramic insulator and around the high voltage electrode, the semi-conductive sleeve extending continuously and uninterrupted along interfaces between the high voltage insulator, the dielectric compliant member, and the ceramic insulator; and compressing the dielectric compliant member between a lower surface of the high voltage insulator and an upper surface of the ceramic insulator, and the lower surface of the high voltage insulator is rounded;

the step of compressing the dielectric compliant member including forming a hermetic seal between the high voltage insulator and the ceramic insulator.

9. The method of claim 8, wherein the dielectric compliant member pushes air outwards from between the high voltage insulator and the ceramic insulator during the step of compressing the dielectric member.

10. The method of claim 8, wherein the dielectric compliant member is formed of silicon paste or injected molded silicon.

11. The method of claim 8, wherein the ceramic material of the ceramic insulator is different from the insulating material of the high voltage insulator.

12. The method of claim 11, wherein the high voltage insulator is formed of rubber or plastic material.

13. The method of claim 8, wherein the semi-conductive sleeve is formed from a semi-conductive and compliant material different from the dielectric compliant member.

14. The method of claim 8 including applying glue to voids along an interface between the dielectric compliant member and the ceramic insulator.

* * * * *